United States Patent [19]

Hafez

[11] Patent Number: 4,477,333

[45] Date of Patent: Oct. 16, 1984

[54] DEWAXING BY A COMBINATION CENTRIFUGE/CATALYTIC PROCESS INCLUDING SOLVENT DEOILING

[75] Inventor: Mahmoud M. Hafez, Sarnia, Canada

[73] Assignee: Exxon Research and Engineering Co., Florham Park, N.J.

[21] Appl. No.: 552,701

[22] Filed: Nov. 17, 1983

Related U.S. Application Data

[63] Continuation-in-part of Ser. No. 426,709, Sep. 29, 1982, abandoned.

[51] Int. Cl.[3] ..... C10G 73/02; C10G 73/06; C10G 73/28

[52] U.S. Cl. ..... 208/30; 208/33; 208/87

[58] Field of Search ..... 208/30, 28, 37, 111, 208/87, 33

[56] References Cited

U.S. PATENT DOCUMENTS

| | | | |
|---|---|---|---|
| 3,159,563 | 12/1964 | Anastasoff et al. | 208/37 |
| 3,350,297 | 10/1967 | Torobin | 208/37 |
| 3,388,054 | 6/1968 | Keith, Sr. | 208/37 |
| 3,654,128 | 4/1972 | Woodle | 208/33 |
| 3,755,138 | 8/1973 | Chen et al. | 208/33 |
| 3,773,650 | 11/1973 | Hislop et al. | 208/33 |
| 3,956,102 | 6/1976 | Chen et al. | 208/111 |
| 3,960,705 | 6/1976 | Garwood et al. | 208/111 |
| 4,137,148 | 1/1979 | Gillespie et al. | 208/87 |
| 4,368,112 | 1/1983 | Thompson et al. | 208/31 |

*Primary Examiner*—Delbert E. Gantz
*Assistant Examiner*—Glenn A. Caldarola
*Attorney, Agent, or Firm*—Joseph J. Allocca

[57] ABSTRACT

A hydrocarbon dewaxing process comprising the steps of:

(a) chilling the waxy hydrocarbon feed to be dewaxed in the absence of solvent to crystallize a portion of the hard wax;

(b) introducing the hydrocarbon feed to be dewaxed into a centrifuge;

(c) centrifuging the solvent free hydrocarbon feed thereby generating two streams, stream (I) comprising a major portion of oil with a minor portion of entrained wax, stream (II) comprising a major portion of wax with a minor portion of entrained oil;

(d) adding a dewaxing solvent to stream (II) generating a slurry A;

(e) feeding slurry A to a centrifuge thereby separating slurry A into an oil-solvent stream (III) and a wax-solvent stream (IV);

(f) passing the oil-solvent stream (III) to a membrane separation unit wherein the stream is separated into a recycle solvent stream and an oil-solvent stream of reduced solvent content (stream V);

(g) passing oil-solvent stream (V) to an oil recovery unit wherein the stream is separated into a recycle solvent stream and an oil stream (VI);

(h) passing the wax-solvent stream (IV) of step (e) to a wax recovery unit wherein the stream is separated into a recycle solvent stream and a recovered wax product stream;

(i) combining wax-oil stream (I) of step (c) with oil stream (VI) of step (g) and passing the combined stream to a catalytic dewaxing unit wherein the combined waxy oil stream, in the presence of hydrogen, is contacted with a catalyst and has its wax content reduced, thereby generating a dewaxed oil product stream.

8 Claims, 1 Drawing Figure

DEWAXING BY A COMBINATION CENTRIFUGE/CATALYTIC PROCESS INCLUDING SOLVENT DEOILING

CROSS-REFERENCE TO RELATED APPLICATION

This application is a continuation-in-part of co-pending application U.S. Ser. No. 426,709 filed Sept. 29, 1982, now abandoned.

A process is described for dewaxing waxy hydrocarbon feeds comprising a combination of (1) solvent free centrifugation; (2) solvent addition; (3) centrifugation; (4) membrane separation; and (5) catalytic dewaxing.

In particular, the process comprises the steps of:

(a) chilling the hydrocarbon feed to be dewaxed in absence of solvent to crystallize a portion of the wax (hard wax);

(b) introducing the chilled hydrocarbon feed slurry to be dewaxed into a centrifuge;

(c) centrifuging the solvent free hydrocarbon feed thereby generating two streams, stream (I) comprising a major portion of oil with a minor portion of entrained wax, stream (II) comprising a major portion of wax with a portion of entrained oil;

(d) adding a dewaxing solvent to stream (II) generating a slurry A;

(e) feeding slurry A to a centrifuge thereby separating slurry A into an oil-solvent stream (III) and a wax-solvent stream (IV);

(f) passing the oil-solvent stream (III) to a membrane separation unit wherein the stream is separated into a recycle solvent stream with an oil-solvent stream of reduced solvent content (stream V);

(g) passing oil-solvent stream (V) to an oil recovery unit wherein the stream is separated into a recycle solvent stream and an oil stream (VI);

(h) passing the wax-solvent stream (IV) of step (e) to a wax recovery unit wherein the stream is separated into a recycle solvent stream and a recovered wax product stream;

(i) combining wax-oil strean (I) of step (c) with oil stream (VI) of step (g) and passing the combined stream to a catalytic dewaxing unit wherein the combined partially dewaxed oil stream, in the presence of hydrogen is contacted with a catalyst and has its wax content reduced, thereby generating a dewaxed oil product stream. The catalytic dewaxing unit converts the wax either into low molecular weight products which are recovered as off gases or into materials boiling in the lube oil boiling range.

BACKGROUND OF THE INVENTION

The production of mineral oils, lube oils, transformer oils, other specialty oils and various and sundry fuels and other products involves, in addition to distillation and extraction, the process of dewaxing. This process is necessary to remove the paraffinic (wax) components of the oil or fuel involved, thus facilitating its use for various purposes under a variety of conditions and environments including low temperatures. In general, it has been found that there are two wax components in each feed stock that must be removed to attain the required oil or fuel properties, the high melting point waxes (or hard waxes) and the low melting point waxes (or soft waxes).

Dewaxing of oils and fuels can be done in two different ways. The first approach involves the physical, nondestructive separation of the wax (or paraffin) molecules from the oil by crystallization.

Simple dewaxing can be practiced merely by reducing the temperature of the stock to be dewaxed to a low enough point so as to induce the crystallization of the wax. This is practical when the wax to be removed is relatively high melting, when the amount to be removed is relatively small, and/or when the oil being dewaxed is relatively light, i.e., does not become unmanageable due to high viscosities at low temperature.

Alternatively and preferably, the stocks are dewaxed by solvent dewaxing processes, which are well known in the art, in which solvent and feed are chilled to crystallize the wax which is then removed. These processes employ various solvents which reduce the solubility of the wax in the oil and also exert a dilution effect on the feed stock.

The simplest solvent dewaxing process involves the introduction of an appropriate solvent, at an appropriate volume (dilution) into the stock to be dewaxed, forming a mixture, and reducing the temperature of the mixture to the desired wax filtration temperature. This procedure is exemplified by typical incremental dilution processes using scraped surface chillers. The use of scraped surface chillers, however, is plagued with the problems of deposition of precipitated wax on the heat exchanger surfaces with the resulting pressure drop and the crushing of the wax crystals by the scraper blades which contribute to poor filtration.

As a response to these problems the incremental dilution chilling process was developed. The DILCHILL (DILCHILL is a registered service mark of Exxon Research and Engineering Company) dewaxing process involves the cooling of the waxy hydrocarbon oil stock in an elongated stirred vessel, preferably a vertical tower, with a prechilled solvent that will solubilize at least a portion of the oil stock while promoting the precipitation of the wax. Waxy oil is introduced into the elongated staged cooling zone or tower at a temperature above its cloud point. Cold dewaxing solvent is incrementally introduced into said zone along a plurality of points or stages while maintaining a high degree of agitation therein so as to effect substantially instantaneous mixing of the solvent and wax/oil mixture as they progress through said zone, thereby precipitating at least a portion of the wax in said oil. DILCHILL dewaxing is discussed in greater detail in the U.S. Pat. Nos. 3,773,650 and 3,775,288.

To complete the solvent dewaxing processes two main separations are involved, namely the separation of the precipitated wax crystals from the solvent-oil mixture and then the separation of the solvent from the oil.

The prior art extensively describes the use of filters, in particular rotary filters, for wax crystal removal from solvent-oil mixtures and presents a large number of modifications to improve separation efficiency. Despite these improvements, filters still suffer from the fact that the wax cake they produce contains a large amount of liquid. This liquid (solvent and oil) means loss of yield (oil lost with wax) and requires the expenditure of much energy in distillation so as to recover solvent from the wax for recycle. These facts and drawbacks have led to the use of two or more filters in series to increase yield. The use of centrifuges for this wax/solvent-oil separation has also been considered. Filtering centrifuges which are a direct extension of filters have been used.

They are, however, limited in usefulness to recovering dewaxing solvents denser than the wax (e.g., chlorinated solvents). Centrifuges are useful in wax crystal separation provided that trace wax contamination in the centrate (liquid overlow from the centrifuge) can be tolerated.

The separation of oil from solvent is commonly done by standard distillation techniques. Over the years this separation has been improved by new tower design and heat integrations. Despite these improvements, however, distillation of solvent from oil is still very energy intensive. Among the reasons for this is the fact that very large volumes of solvent must be distilled (4 to 6 volumes solvent/volume oil) and that no matter how well the heat integration is performed, efficiency is seldom above 60%.

The use of membrane processes for liquid/liquid separations have received attention recently (see A. S. Michaels 7th World Pet. Conf. 4 21, 1967), the main reason being their energy efficiency, which comes about because they do not require phase changes (e.g., liquid to vapor as does distillation) to effect the separation. While most of the effort on the use of membranes has been limited to aqueous systems, some studies of the liquid permeation and separation of non-aqueous mixtures have been reported. European Patent Application EP No. 13,834 describes a membrane and a process using said membrane, whereby solvent can be partially (50%) removed from oils. Other patents have described the use of membranes for hydrocarbon separations. See for example U.S. Pat. No. 4,154,770, U.S. Pat. No. 3,043,891 and U.S. Pat. No. 2,970,106.

The second approach to waxy feedstock dewaxing is a relatively new technique that relies on destructively removing the wax molecules. This is done by subjecting the wax molecules to a catalyst in the presence of hydrogen, whereupon the wax molecules in the feed are cracked to smaller molecules, or isomerized.

U.S. Pat. No. 3,700,585, now U.S. Pat. No. Re. 28,398, which deals with the dewaxing of oils by shape selective cracking and hydrocracking over specific zeolite materials, is fairly representative of this type of process. Other patents which deal with catalytic dewaxing are U.S. Pat. Nos. 3,980,550; 3,893,906; 3,968,024; 4,137,148; 3,663,430; 4,176,050; 4,181,598. U.S. Pat. No. 3,755,138 and Canadian Pat. No. 903,696 disclose the combinations of solvent and catalytic dewaxing.

Catalytic dewaxing suffers from the disadvantage that wax molecules are not recovered, but rather destroyed. Catalytic dewaxing must be conducted under conditions severe enough to crack the hard, high melting waxes. Its main advantage, however, is its relatively lower cost in both initial investment and operation.

In summary then, we see that there are basically two dewaxing schemes: solvent dewaxing which requires large volumes of solvent, low temperature and is energy intensive, but produces a wax product which can be sold; and catalytic dewaxing which is relatively simple, inexpensive, but requires hydrogen, must be severe enough to remove hard wax, and removes wax by destructive conversion. We also see that in solvent dewaxing following the wax crystallization, additional steps are required to effect liquid/solid and liquid/liquid separations and these involve (a) filters which leave substantial volumes of solvent in the wax; (b) centrifuges which reduce the quantities of liquid in the wax (thus being an improvement in yield and energy use), but are mostly suitable for solvents denser than wax and suffer from the possibility that trace wax may be present in the liquids (centrate overflow); (c) distillation which is energy intensive,; or (d) membranes which are not energy intensive.

U.S. Pat. No. 3,078,222 describes a process involving catalytic hydrogenation of aromatics and ring scission followed by solvent dewaxing. Catalytic dewaxing followed by centrifugation is described in U.S. Pat. No. 3,654,128. U.S. Pat. No. 3,755,138 teaches solvent dewaxing followed by catalytic dewaxing. None of these patents, however, suggest the combined solvent dewaxing-catalytic dewaxing process in combination with centrifuge membrane solvent recovery which is the present invention.

DETAILED DESCRIPTION OF THE INVENTION

Figure 1:
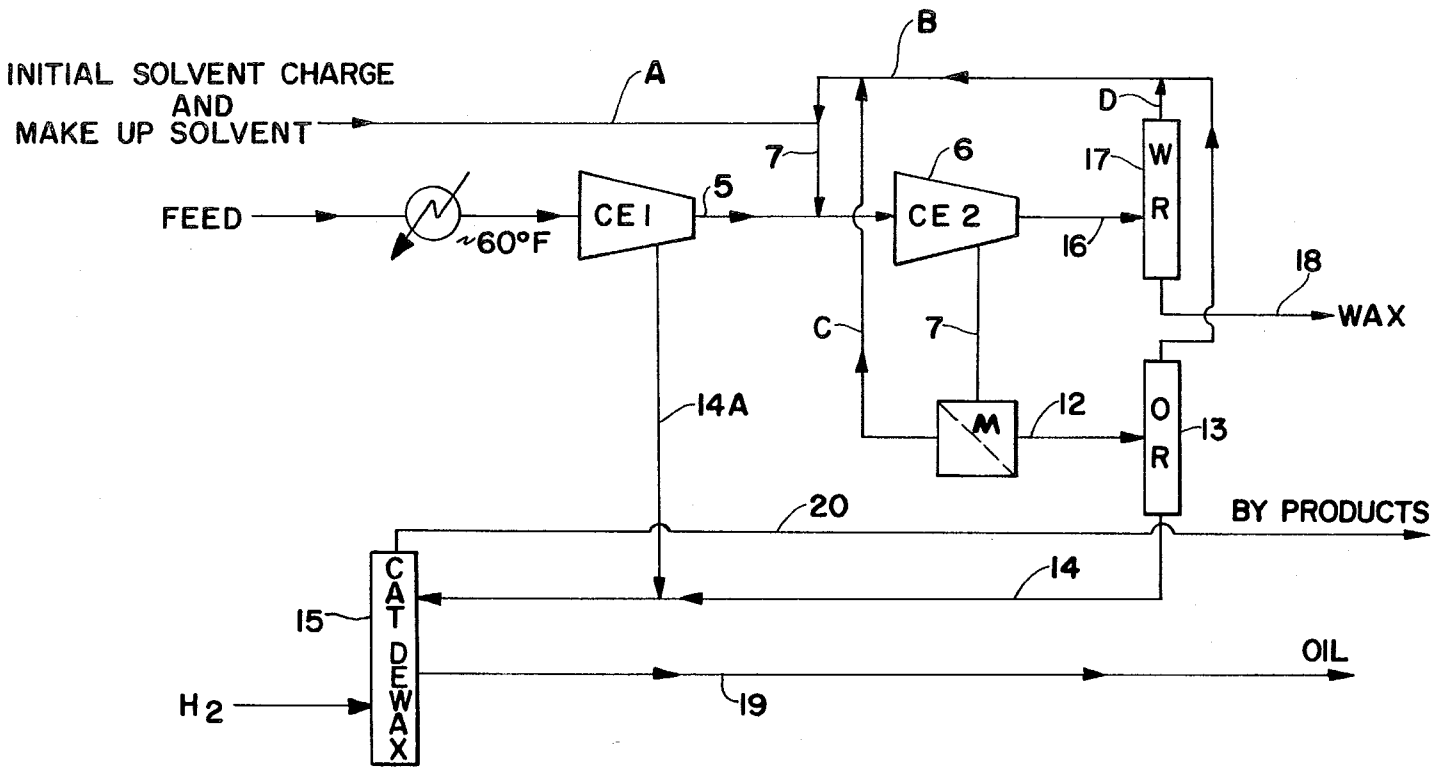
FIG. 1 is a schematic of a preferred embodiment of the present invention.

The process of the present invention is a unique combination of separation and conversion processes to dewax a hydrocarbon feedstock. It represents a significant improvement over the prior art of hydrocarbon dewaxing in that the use of solvents is minimized, the energy consumption is greatly reduced, and only hard wax is produced. By practice of the present invention the optimum use and the full benefit of the involved separations and conversion processes is taken advantage of.

In the process of the present invention a waxy hydrocarbon feed is chilled in the absence of solvent to a moderate temperature (50°–65° F.). This is accomplished by any of the now common indirect chilling methods through various heat exchanger designs. This process results in the crystallization of the hard wax comonent (typically 5–10% on feed) from the feed forming an oil-wax slurry. The slurry is centrifuged by a scroll, decanter or tubular centrifuge to produce a wax cake containing a fair amount of oil (40–50% oil in the wax cake) and an oil centrate (yield $\geqq$80% on feed) containing traces of entrained wax. This initial chilling-/centrifugal partial dewaxing is distinctly different from conventional art in that no solvent is used. It offers a number of advantages including: (a) operation at higher temperatures (60°–80° F. higher than conventional solvent dewaxing), saving significant amounts of energy; (b) operation in absence of solvents (usually 3–5 volumes of solvents per volume of feed are used in conventional dewaxing) completely eliminates solvent recovery from the partially dewaxed oil; (c) operation in absence of solvents also results in significant reduction in the volumes to be processed by the centrifuges (about 70–80% reduction in size compared to solvent dewaxing). Fewer and smaller centrifuges can be used with significant cost savings. In this scheme centrifuges can be exploited to their maximum potential without limitations on the clarity of the partially dewaxed oil, nor on the dryness of the wax cake, as both the partially dewaxed oil and wax cake are further processed as described below.

The wax cake (containing ~40–50% oil) constitutes about 10–20% of the total feed. This wax cake is deoiled by repuddle with solvent (~0.3–0.7 volumes per volume of wax feed) at the same temperature (~50°–60° F.). The resulting slurry is itself separated using another centrifuge (of the types mentioned above) to yield a deoiled wax cake containing small amounts of solvent (~1:1) and much less oil (<8%), and an oil-solvent centrate containing about 85–95% solvent (balance in oil) and traces of wax. The wax cake is subjected to typical separation procedures such as, preferably, distillation to recover the solvent which is recycled to the process. The dewaxed oil-solvent centrate is first processed through a membrane unit to recover 40–50% of the solvent as permeate containing less than 3% oil which is recycled to the process, while the retentate containing 35–40% oil is separated as by distillation to separate the oil and recover the solvent for recycle. When the membrane process and e.g. the distillation tower respectively are combined in series, as in the present invention, and based on a 50% recovery of solvent by the use of the membrane, the total energy expenditure needed to achieve total separation of oil from solvent is reduced by an estimated 35% as compared to distillation alone (based on calculation). All recovered solvent streams are recombined and recycled to the process.

Because the wax cake to be solvent deoiled is a small fraction of the feed, the use of solvent is limited to less than 20% of the solvent typically used in conventional dewaxing and the smaller volume may be used at higher temperatures. This has a marked impact on the solvent recovery operations which are further improved by using a membrane process ahead of and in series with distillation resulting in further energy savings. The recovered wax from the above steps is essentially the high melting wax (so called hard wax) suitable for wax manufacture. This leaves behind a partially dewaxed oil which is further processed as described below.

The partially dewaxed oil streams obtained from the first chilling/centrifugation process and that obtained from the deoiling of the hard wax, are mixed. The combined stream is then catalytically dewaxed in the presence or absence of $H_2$ over a suitable catalytic dewaxing catalyst to the required dewaxed oil targets.

The catalytic dewaxing process is also made more efficient because the hard wax has been already removed from the feed. Hard wax is difficult to crack, requires more $H_2$ consumption and more severe conditions (temperature and $H_2$ pressure) resulting in shorter catalyst life. All these drawbacks are eliminated using the practice of the current invention.

The process of the present invention can be effectively utilized in the dewaxing of waxy hydrocarbon oil feed streams, preferably waxy petroleum oil feed streams, more preferably waxy lube, transformer oil or specialty oil feed streams. The process may also be employed in the overall processing scheme for white oil production and even in the production of low wax content kerosene and jet fuels. Suitable feed streams are the natural or synthetic hydrocarbon streams, in particular, petroleum distillate fractions which boil 300° F. to 1,300° F., preferably from 725° F. to 1,040° F. Typical fractions from such waxy crudes have an initial wax content of from about 10 wt.% to 20 wt.% and initial pour cloud points of between 80° F. to 130° F. Residual petroleum fractions, boiling about 1,000° F., from which the asphalt has been removed, are also satisfactory feedstocks. As previously stated, the preferred stocks are the lubricating oil and specialty oil fractions which boil within the range of 550° F. and 1,200° F. These fractions may come from any source, such as paraffinic crudes, naphthenic crudes, and synthetic crudes, such as coal liquids, tar sand oil, and shale oil.

Any selective solvent may be used in the deoiling process of this invention. Representative examples of such solvents are: the aliphatic ketones having from 3 to 6 carbon atoms, such as acetone, methylethylketone (MEK), and methyl-isobutyl-ketone (MIBK) and mixtures thereof; aromatic hydrocarbons having 6–10 carbons and mixtures thereof; mixtures of aliphatic ketones and aromatic compounds having from 6 to 10 carbons, such as benzene and toluene. In addition, halogenated low molecular weight $C_2$–$C_4$ hydrocarbons, such as $C_2$–$C_4$ chlorinated hydrocarbons, e.g., dichloromethane and dichloroethane and mixtures thereof may be used as solvents. Further, mixtures of such halogenated hydrocarbons with the aforesaid aliphatic ketones and/or aromatic compounds may also be used as solvent. Specific examples of suitable solvent mixtures are methylethyl-ketone and methyl-isobutyl-ketone, methylethyl-ketone and toluene, dichloromethane and dichloroethane, dichloromethane and methylethyl-ketone, dichloromethane and methyl-isobutyl-ketone. The most preferred solvent pair is methylethyl-ketone and methyl-isobutyl-ketone.

The catalytic dewaxing procedures employed in the present invention may employ any of the typical dewaxing catalysts described in the literature including mordenite, offretite (natural and synthetic), chabazite, analcite, erionite and other natural or synthetic zeolites such as ZSM-5 and other ZSM family zeolites, as well as zeolite A, zeolite X, etc., with or without any added hydrogenation components, such as Group IVB-Group VIII transition metals (and their compounds) (Periodic Table [Handbook of Chemistry and Physics, Chemical Rubber Company, 45th Ed., 1964]), preferably Group VI and Group VIII transition metals, and with or without any decationization of the sites present on the catalytic material, under typical dewaxing conditions of temperature, pressure, hydrogen treat rate, space velocity, etc. Preferably, however, the catalytic material is at least partially decationized to the hydrogen form and this H form material bears at least a minor amount of the above-recited hydrogenation components. This dewaxing step will constitute, typically, either hydrocracking or hydroisomerization, depending on the catalyst selected and the conditions employed, which selections are left to the discretion and preference of the practitioner.

The requirements which must be met by the membranes employed in the separation scheme are that the membrane selected and employed be inert to the oil and any solvent used and the membrane after exposure to oil and solvent possess pore sizes small enough such that it does not demonstrate unhindered free passage of all molecules thereby having no selectivity. It must also be free of rips, tears and holes, otherwise, as in the case where the pore size is too large, there will be unhindered free passage of all molecules and no separation could be effected. The membrane must be resistant to the conditions employed to facilitate permeation, which conditions include creation of a pressure gradient. Preferably, the membrane separation process employed is reverse osmosis, i.e., a separation under an applied pressure which applied pressure is sufficient to overcome the osmotic pressure.

Membranes are typically characterized in terms of molecular weight cut-off ranges or equivalent "pore size". The "pore size" of a semipermeable membrane cannot be categorically stated for many reasons. Pore size may be too small to be measured by physical methods. Pore sizes change with temperature and with each encountered solvent saturated within the membrane due to swelling or shrinkage, etc. A common approach used in the industry to size membranes for use in aqueous separations is to distinguish solvents too large to diffuse through the membrane from those small enough to diffuse through it. For example, for aqueous system separations this can be accomplished using a membrane "sizing" kit which employs compounds which are roughly spherical in shape. The molecular weight cut-off is quoted as the formula weight of the compound which is 98% retained by the membrane. Thus, for example, a membrane characterized as having a molecular weight cut-off of from between about 6,000 to 8,000 will, in general, not permit permeation of generally spherical protein molecules having a molecular weight exceeding from about 6,000 to 8,000.

For the solvent-oil separation, for example, the process of the instant invention can use the especially developed semipermeable reverse osmosis regenerated cellulose membranes described in detail in European Patent Application EP No. 13,834 (see copending applications U.S. Ser. Nos. 263,116, 263,115 and 263,307, hereby incorporated by reference), but other membranes which are capable of performing a similar function may also be used. This membrane was selected having a pore size such that after pretreatment it will provide the desired selectivity, i.e., oil molecules rejection and solvent molecules permeation. For this regenerated cellulose membrane a molecular weight cut-off of from about 6,000 to about 8,000 having an average pore size of roughly about 24 Å was found optimum. While the membrane pore size given above is based on aqueous systems and will change upon exposure to the organic systems (ketone-oil), the above presented general pore sizing scheme is still valid to initially screen potentially useful membranes.

In copending application, U.S. Ser. No. 494,543, filed May 13, 1983 a process for separating dewaxing solvents containing ketone from dewaxed oil using specially formulated asymmetric polyimide polymer membranes is described. The polyimide polymer starting material is preferably recovered from commercially available solutions of the polymer in solvent. Upjohn 2080 DHV, which contains about 25% polymer in DMF solvent, is a suitable source. The polymer itself is the subject of U.S. Pat. No. 3,708,458. As described in U.S. Ser. No. 494,543, one liter of Upjohn 2080 DHV is transferred to a blender and three successive 300 ml portions of acetone are added with 5 min. mixing at low speed between each addition. Subsequently, the blender contents are emptied into a container and permitted to settle. The liquid is decanted and 1.5 liters of acetone added and the mixture stirred thoroughly. The mixture is filtered through a course filter (Whatman #4). The polymer is washed by remixing with another 2 liters of acetone. After filtering, the polymer is dried in vacuum (15 inches Hg) at 45°–60° C. for 3 hours. The polymer powder is ready for use.

A suitable membrane can be cast from this polymer using a casting solution comprising about 18–25 weight percent (preferably about 22 weight percent) polymer in dioxane:DMF solvent (4:1 to 8:1 D/DMF, preferably about 6:1). This solution is spread on a moving casting belt at a casting speed of about 3–5 ft/min and the film allowed to evaporate in dry air for about 20 seconds before gellation in a gellation bath, which is preferably water (neutral pH). The gellation water is preferably replaced with glycerin to retard membrane deterioration (hydrolysis). The membrane can be fabricated into a spiral-wound element. Spiral wound membrane element configurations are generally described in U.S. Pat. Nos. 3,417,870: 3,173,867; 3,367,504; 3,386,583; and 3,397,790, to list just a few.

For use in a ketone solvent-dewaxed oil separation process the spiral wound element will typically comprise layers or the selected membrane (e.g., regenerated cellulose of polyimide) wound around a central tube (metal or solvent resistant plastic) containing holes for the permeate, the membrane layers being separated by alternate layers of a permeate carrier, such as knitted Simplex (Dacron, with melamine formaldehyde stiffener), and a feed spacer made of Vexar (a polypropylene mesh). Membrane layers are sealed using an epoxy adhesive to sandwich the permeate cloth into a closed envelope in fluid communication with the perforated central tube leaving the perforations in the central tube as the only permeate outlet. The epoxy adhesive will generally comprise a ketone resistant resin formulation, such as one comprising (1) Epon 828, which is a reaction product of bisphenol-A and epichlorohydrin; (2) Cabosil M5; (3) Versamid 140 (a polyamide curing agent); (4) Estane 5707F-1 (a polyurethane from B. F. Goodrich); and (5) DMF solvent wherein the components 1/2/3/4/5 are present in typical relationship based on parts by weight of about 100/10/60/4/12, which cures at about 25° C. over a 21 day period. This adhesive system is described and claimed in copending application U.S. Ser. No. 494,409, filed May 13, 1983. The layers of membrane, permeate carrier, and feed spacer are wound around the central tube in a fashion consistent with preparing a spiral wound element. After the element is cured, the ends of the element are trimmed, a nylon seal carrier and a nylon anti-telescoping device are then added. The element is then covered on the outside with an epoxy reinforced fiberglass outer wrap. Elements of any size can be prepared, but typical elements are about 8 inches in diameter and about 40 inches long, and have about 225 square feet of membrane area and can be used at feed flow rates of about 30–50 gallons per minute at a 515 psi pressure drop.

The centrifugal separation process for wax-oil separation and that of wax-solvent separation can be conveniently carried out in scroll, decanter or tubular centrifuges. These centrifuges produce dry wax cakes (wax:oil or solvent about 1:1 to 2:1) as compared with conventional rotary vacuum filters (ratios of 4:1 to 8:1). These centrifuges are also capable of excellent clarification and have been shown to easily handle viscous systems. As with all centrifuges, the liquid overflow (centrate) is never completely wax-free; traces of wax are usually entrained. While this has in the past limited the applicability of centrifuge use in wax removal, the current combination can tolerate this limitation because the oil centrates are to be further dewaxed catalytically. The preferred operating conditions of the centrifuge are solvent/oil ratio of about 5–10, operating speed about 1600–2200 G's.

FIG. 1 is a schematic of the process of the present invention. The waxy hydrocarbon oil feed is fed via line (1) to heat exchanger (2) wherein the temperature of the feed is reduced to about 60° F. or some other temperature sufficiently low to cause most of the hard wax to crystallize out of the oil, and form an oil-wax slurry. This slurry is passed from heat exchanger (2) via line (3) to centrifuge (4) wherein the feed is separated into two streams; stream I being a predominantly wax/minor volume oil stream and stream II being a predominantly oil/minor volume wax stream to centrifuge (6), after solvent via line (7), made up of make up solvent from line A and recycle solvent from lines B and C, is metered in line (5) to deoil the wax in the stream. This solvent diluted slurry is centrifuged in centrifuge (6) into two streams, stream III being an oil-solvent stream, and stream IV being a wax-solvent stream. Stream III is passed via line (8) to a membrane separation unit (9) while stream IV is passed via line (10) to a waxy recovery unit (11). Membrane unit (9) separates stream III into two streams, a recycle solvent stream which leaves unit (9) via line C for recycle in line (7), and an oil-solvent stream of reduced solvent content, stream V, which is passed via line (12) to oil recovery unit (13) wherein oil is separated from solvent, recovered oil being passed via line (14) to cat dewaxer unit (15). Stream IV from centrifuge (6) is passed via line (16) to wax recovery unit (17) with recovered solvent being passed via line D to recycle line (7) and wax product being passed via line (18) to storage or for further processing (not shown). The partially dewaxed oil from centrifuge (4) (stream II) is passed via line (14A) to line (14) wherein it is combined with the partially dewaxed oil coming from oil recovery unit (13) for passage into catalytic dewaxing unit (15). In unit (15), this oil is combined with hydrogen and contacted with a dewaxing catalyst under conditions wherein the wax content on the oil is reduced with the dewaxed oil being passed via line (19) to oil storage or for further treating (now shown) and any byproduct off gas being vented from unit (15) via line (20).

What is claimed is:

1. A hydrocarbon dewaxing process comprising the steps of:

(a) chilling the waxy hydrocarbon feed to be dewaxed in the absence of solvent to crystallize a portion of the hard wax;

(b) introducing the hydrocarbon feed to be dewaxed into a centrifuge;

(c) centrifuging the solvent free hydrocarbon feed thereby generating two streams, stream (I) comprising a major portion of oil with a minor portion of entrained wax, stream (II) comprising a major portion of wax with a minor portion of entrained oil;

(d) adding a dewaxing solvent to stream (II) generating a slurry A;

(e) feeding slurry A to a centrifuge thereby separating slurry A into an oil-solvent stream (III) and a wax-solvent stream (IV);

(f) passing the oil-solvent stream (III) to a membrane separation unit wherein the stream is separated into a recycle solvent stream and an oil-solvent stream of reduced solvent content (stream V);

(g) passing oil-solvent stream (V) to an oil recovery unit wherein the stream is separated into a recycle solvent stream and an oil stream (VI);

(h) passing the wax-solvent stream (IV) of step (e) to a wax recovery unit wherein the stream is separated into a recycle solvent stream and a recovered wax product stream;

(i) combining wax-oil stream (I) of step (c) with oil stream (VI) of step (g) and passing the combined stream to a catalytic dewaxing unit wherein the combined waxy oil stream, in the presence of hydrogen, is contacted with a catalyst and has its wax content reduced, thereby generating a dewaxed oil product stream.

2. The process of claim 1 wherein the solvent free waxy hydrocarbon feed in step (a) is chilled to a temperature of 50°-60° F.

3. The process of claim 1 wherein the centrifuge is a scroll, decanter of tubular centrifuge.

4. The process of claim 1 wherein the deoiling solvent is an aliphatic ketone having 3 to 6 carbon atoms and mixtures thereof; mixtures of aliphatic ketones and aromatic hydrocarbons having 6 to 10 carbons; aromatic hydrocarbon having 6 to 10 carbons and mixtures thereof; halogenated $C_2$–$C_4$ hydrocarbons and mixtures thereof; mixtures of halogenated $C_2$–$C_4$ hydrocarbons and aliphatic $C_3$–$C_6$ ketones; and mixtures of halogenated $C_2$–$C_4$ hydrocarbons and aromatic $C_6$–$C_{10}$ hydrocarbons.

5. The process of claim 1 wherein the membrane separation procedure of step (f) is a reverse osmosis procedure.

6. The process of claim 1, 2, 3, 4, or 5 wherein the waxy hydrocarbon feed which is dewaxed is a waxy petroleum oil.

7. The process of claim 6 wherein the waxy hydrocarbon feed is a lube oil, transformer or specialty oil.

8. The process of claim 1 wherein the oil recovery unit of step (g) and the wax recovery unit of step (h) are distillation units.

* * * * *